US005983965A

United States Patent [19]

Patrick

[11] Patent Number: 5,983,965

[45] Date of Patent: Nov. 16, 1999

[54] EXPANDER FOR FLEXIBLE BABY BOTTLE LINER

[76] Inventor: Bryan Allen Patrick, 145 Ramon Way Dr., St. Petersburg, Fla. 33704

[21] Appl. No.: 09/131,610

[22] Filed: Aug. 10, 1998

[51] Int. Cl.[6] ..... B65B 1/04

[52] U.S. Cl. ..... 141/391; 141/114; 141/317; 222/386.5

[58] Field of Search ..... 141/391, 38, 311 R, 141/314, 317, 114, 363, 366, 383, 386, 65, 67, 70, 313, 316, 48, 63; 222/105, 183, 386.5; 53/175; 600/499

[56] References Cited

U.S. PATENT DOCUMENTS

| | | | |
|---|---|---|---|
| 601,877 | 4/1898 | Lochmann | 222/130 |
| 659,758 | 10/1900 | McGiven . | |
| 795,108 | 7/1905 | Doellinger . | |
| 1,269,620 | 6/1918 | Levine | 600/499 |
| 2,063,430 | 12/1936 | Graser . | |
| 2,283,100 | 2/1942 | Shores . | |
| 2,513,455 | 7/1950 | Cornelius . | |
| 2,565,679 | 8/1951 | Dunn et al. . | |
| 2,592,347 | 9/1952 | Shute . | |
| 2,795,245 | 6/1957 | Meehan | 141/26 |
| 2,912,791 | 11/1959 | Cohen . | |
| 3,662,929 | 5/1972 | Sims | 222/386.5 |
| 3,790,017 | 2/1974 | Fitzpatrick et al. | 215/11.3 |
| 3,936,334 | 2/1976 | Kushida et al. | 156/69 |
| 4,657,151 | 4/1987 | Cabernoch | 215/11.6 |
| 4,875,508 | 10/1989 | Burke, II et al. | 141/2 |
| 5,343,901 | 9/1994 | Meshberg | 141/2 |
| 5,579,813 | 12/1996 | Watts | 141/317 |
| 5,667,110 | 9/1997 | McCann et al. | 222/386.5 |
| 5,699,920 | 12/1997 | Ida et al. | 215/11.3 |
| 5,794,670 | 8/1998 | LaFleur | 141/314 |
| 5,848,623 | 12/1998 | Ueda | 141/64 |

*Primary Examiner*—Steven O. Douglas
*Assistant Examiner*—Khoa D. Huynh
*Attorney, Agent, or Firm*—Harold D. Shall

[57] ABSTRACT

An expander for a flexible liner in the shell of a baby bottle including a squeezable bulb to supply air and connected confluently to an adapter having a one-way valve therein and with the adapter being sealingly inserted into the open end of the liner.

5 Claims, 2 Drawing Sheets

EXPANDER FOR FLEXIBLE BABY BOTTLE LINER

BACKGROUND OF THE INVENTION

1. Field of the Invention

This invention relates to devices for use with flexible baby bottle liners and more particularly to a device for expanding such a flexible liner into a liquid receiving status after the liner has been placed in an outer graspable shell.

2. Description of the Prior Art

Bottle shells, usually of plastic and having openings in the walls and/or bottom thereof and adapted to have a fluid receiving flexible lining therein, are well known in the baby bottle art. However the liner, when inserted, is not expanded sufficiently to allow liquid to be properly placed therein. Thus, either the volume of liquid placed into the liner is less than desired and, since the liner is not expanded completely, it is difficult to view the liner and accurately determine the amount of liquid therein. To achieve full expansion the usual method is to place one's mouth on the shell and blow into the liner.

One liner package suggests partially filling the bottle and then banging it on a counter top to help expand the liner. This is only a marginal solution. Pre-formed, drop-in liners are an attempt to over come these shortcomings; however, drop-in liners do not fully form to fill the shell and are much more expensive than the usual liner.

SUMMARY OF THE INVENTION

The present invention provides a safe, sanitary and easy method of expanding a baby bottle liner within the bottle shell. This is done by providing a charge of air into the liner in the shell assembly thereby expanding the liner. To accomplish this, an adapter member is placed onto the liner-shell assembly in the place a nipple would normally be applied, which adapter has a central opening in the top thereof and into this central opening a source of air is supplied, which source supplies air through the adapter, and into the liner to fully expand the liner. With compressible bulb as shown herein, a one way valve can be placed in the air source to prevent the air from being withdrawn from the liner when the bulb is allowed to re-expand, and an inlet valve is present in the bulb, remote from the adapter for allowing the bulb to re-expand to allow further charges of air into the liner. The adapter is then removed, the liner filled with liquid and a nipple containing cap is placed on the assembly.

DETAILED DESCRIPTION OF THE PREFERRED EMBODIMENT

Figure 1:
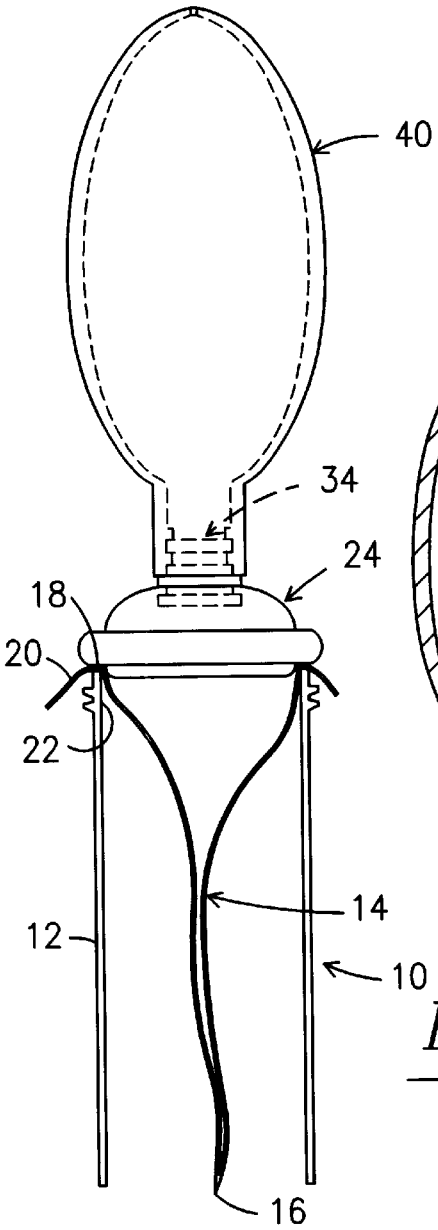
FIG. 1 is a front elevational view showing a compressible bulb mounted in an adapter which in turn is mounted on a bottle-liner assembly, the liner being collapsed.
Figure 2:
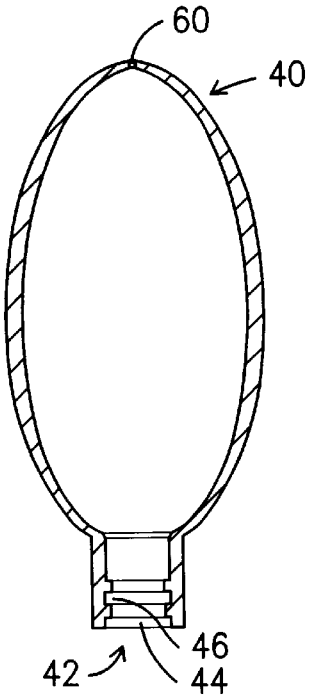
FIG. 2 is a vertical cross sectional view of a compressible bulb.

Referring now to the drawings, FIG. 1 discloses a bottle assembly 10 including a cylindrical shell 12, open at both ends, in which is disposed a collapsed flexible liner 14. The liner 14 has a closed lower end 16 and an upper open end 18 with the upper edge or flap 20 thereof overlapping the upper open end 22 of the shell 12. As seen in this Figure, the liner 14 has been placed in the shell 12 to form the assembly 10. The liner 14 is placed with the flap 20 overlying the open end 22 of the shell, with the liner 14 still in a substantially collapsed position, in which position it is difficult to properly fill it with liquid.

An adaptor, shown generally at 24, includes an annular shoulder 26 at the base thereof, which is dimensional so as to snugly fit into the liner-shell subassembly 10. The adapter 24 has an annular shoulder 28 just above and integral with the shoulder 26 which is dimensional to overly the top of the subassembly 20, while the upper portion 30 of the adapter, which is integral with the shoulder 28, is dome shaped with a central opening 32. The adapter 24 is preferably made of a flexible resilient material such as latex rubber, so that if the liner is over pressured, the adapter will "burp" (that is deflect to allow air to pass) to avoid splitting the liner.

Into the central opening 32 in the adapter 24 a valve body 34 is mounted, with an annular shoulder 36 larger in diameter than the central opening 32, which shoulder is fitted within and sealingly abutting the inner surface 24A of the adapter 24 adjacent the opening 32. A second annular shoulder 38 disposed above the shoulder 36 provides a groove therebetween in which is received the wall of the adapter 24 adjacent the opening 32; the opening 32 being sized to resiliently sealingly fit the adapter 24.

Figure 3:
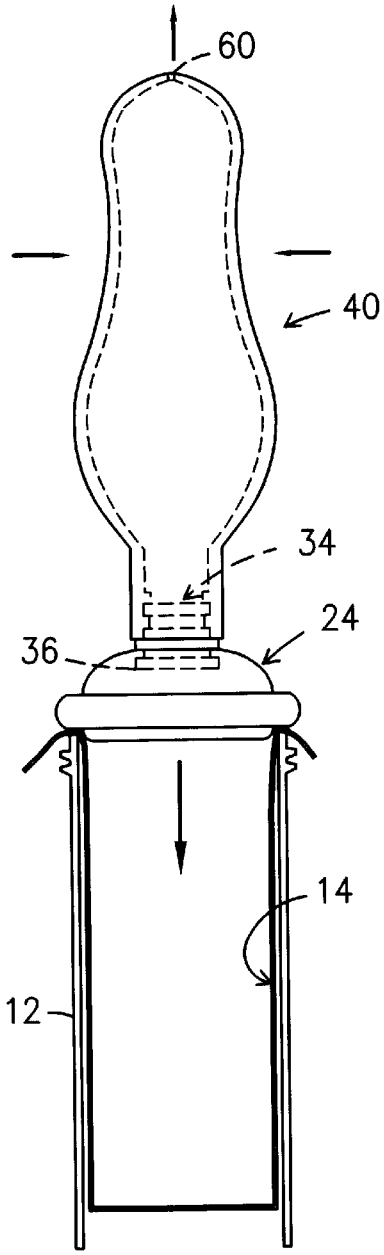
FIG. 3 is a view like FIG. 1 with the bulb compressed and the liner expanded.
Figure 4:
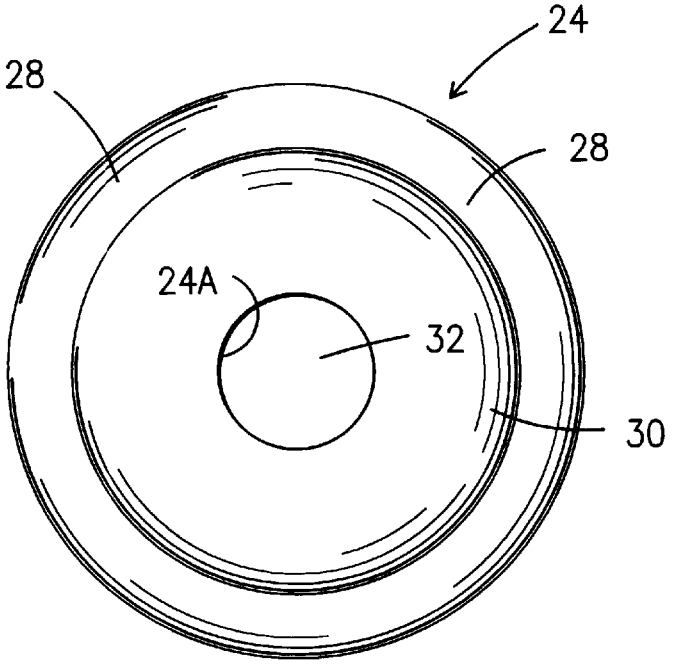
FIG. 4 is a plan view of an adapter for use in this invention.
Figure 6:
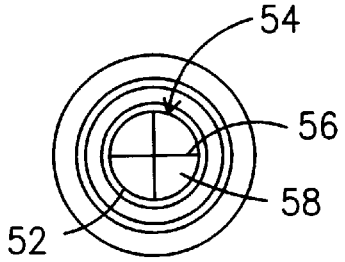
FIG. 6 is a plan view of a valve for use with the bulb shown in FIGS. 1, 2 and 3.
Figure 7:
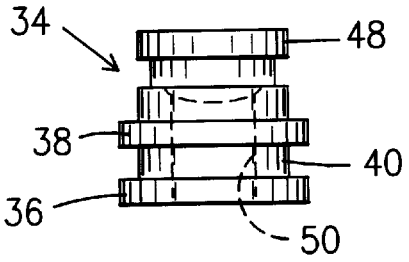
FIG. 7 is a front elevational view of the valve of FIG. 6.
Figure 5:
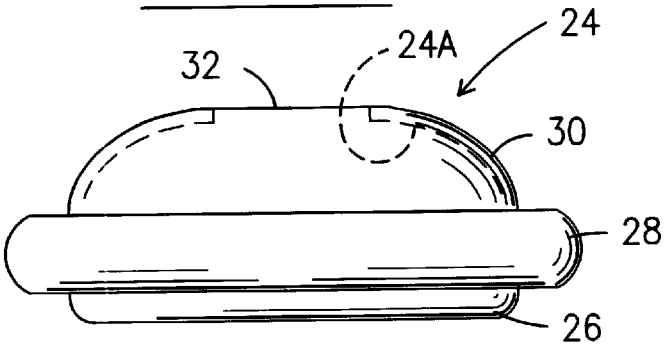
FIG. 5 is a side elevational view of the adapter.

A source of compressed air is shown generally at 40 and is in the shape of an elliptical ball. More particularly, the ball 40 has a lower opening 42, at the lower end of which is an annular grove 44 which receives the top of the annular shoulder 38 of the valve body 34. The valve body 34 has a central longitudinal opening 50 therein into which is securely pressed the annular peripheral shoulder 52 of a one way valve 54. The valve 54, as shown, is made of a flexible resilient material and is semi spherical with the dome thereof directed toward the bottom of the valve body 32 and has two diagonal slits 56 located 90 degrees from each other thereby forming four valve leafs 58 which are normally in abutment thereby "closing" the valve. When the bulb 40 is squeezed, as seen in FIG. 3, air is directed through the leafs 58, which are forced by the flowing air to opening inwardly and allow the air to flow into the liner 14 to thereby expand the liner. One or more pumps will put the liner 14 against the shell 12 as seen in FIG. 3. The bulb 40, when released will contain a partial vacuum, and the air in the liner, while trying to flow out of same, closes and seals the valve leafs 58 to prevent escape therethrough. The bulb 40 has an opening 60 at its end opposite the opening 42, through which air can flow to fill the bulb in preparation for the next pump. The opening 60 in the bulb 40 is substantially smaller than the opening 50 in the valve body 34, so that on the compression of the bulb, while some air can escape through opening 60, such is minimal when compared to the size of opening 50. It should be understood that various constructions of one way valves that function like valve 34 can be used herein. Also, if desired a one-way valve can be inserted in the opening 60 (with an enlarged opening) to provide the function of allowing air into bulb 40 and blocking the exit thereof therethrough when pumping. The heel of the pumping hand can also be placed over the opening 60 when pumping to close the same.

After expanding the liner 14, the assembly of the adapter 24 the valve 34 and the bulb 40 can easily be removed from the assembly of the liner 14 and the shell 12. A nipple carrying member, not shown, can then be placed on the liner-shell assembly after filing the liner with the desired quantity of liquid.

While only a single embodiment has been shown and described, it is understood that modifications can be made without departing from the scope of the invention as claimed.

What is claimed is:

1. An expander for expanding a flexible liner, having an open end and a closed end opposed thereto, disposed in a bottle shell having an upper open end and a lower opening wherein the liner is positioned in the shell with a portion of the liner at its open end overlying the open end of the shell, comprising in combination, a) an adapter member having an upper and lower portion with the lower portion sealingly yet removably received within the open end of a liner disposed in a bottle shell with a portion of the liner at its open end overlying the open end of the shell and the upper portion projecting therefrom, b) a source of selectively actuated compressed air confluent with the upper portion of said adapter, c) a one way valve confluently disposed in said adapter member and confluent with said source of compressed air and said liner for allowing compressed air to enter said flexible liner from said source.

2. An expander according to claim 1 wherein said source of compressed air is a squeezable bulb having its lower output end connected to the said one way valve and with its upper end having air supplying opening therein to supply gas to the bulb when it expands from its compressed condition, and supplying air to said liner through said one way valve when being compressed.

3. An expander according to claim 1 wherein said one way valve inhibits backflow of air from said liner to said source.

4. An expander for expanding a flexible liner having an open end and a closed end opposed thereto, disposed in a bottle shell having an upper open end and a lower opening and wherein the liner is positioned in the shell with a portion of the liner at its open end overlying the open end of the shell, comprising a) a selective source of compressed air, b) connection means sealingly connected in a removable fashion to the open end of a flexible liner disposed in a bottle shell with a portion of the liner at its open end overlying the open end of the shell and to said selective source for allowing compress air from said source to enter and expand said liner.

5. An expander according to claim 4 wherein said connection means includes a one way valve disposed so as to allow compressed air to enter and expand said flexible liner and to not exit said liner until said connecting means is no longer sealingly connected to said flexible liner.

* * * * *